US005988033A

United States Patent [19]

Skaar et al.

[11] Patent Number: 5,988,033

[45] **Date of Patent: *Nov. 23, 1999**

[54] FOOD SLICING APPARATUS, BLADE AND METHOD

[75] Inventors: Gary R. Skaar, Marshall; Timothy T. Watson, Waunakee; Greg C. Wicke, Cambridge; Dennis G. Flisram, Plainfield; Robert B. Glennon, Sun Prairie; Larry C. Gundlach, Madison, all of Wis.

[73] Assignee: Kraft Foods, Inc., Northfield, Ill.

[ * ] Notice: This patent is subject to a terminal disclaimer.

[21] Appl. No.: 08/757,224

[22] Filed: Nov. 27, 1996

Related U.S. Application Data

[63] Continuation-in-part of application No. 08/751,798, Nov. 18, 1996, which is a continuation of application No. 08/328,213, Oct. 25, 1994, abandoned, which is a continuation-in-part of application No. 08/213,494, Mar. 14, 1994, Pat. No. 5,404,777, which is a continuation of application No. 08/968,622, Oct. 29, 1992, Pat. No. 5,320,014.

[51] Int. Cl.[6] ..... B26D 1/12; B26D 5/20

[52] U.S. Cl. ..... 83/596; 83/342; 83/672; 83/676; 83/932

[58] Field of Search ..... 83/355, 437.1, 83/444, 596, 665, 666, 676, 932, 340, 342, 672

[56] References Cited

U.S. PATENT DOCUMENTS

| | | | |
|---|---|---|---|
| 8,193 | 7/1851 | Lazell et al. . | |
| 1,143,285 | 6/1915 | Koella . | |
| 1,809,764 | 6/1931 | Trunz . | |
| 1,957,623 | 5/1934 | Walter . | |
| 2,232,849 | 2/1941 | Glerum . | |
| 2,472,876 | 6/1949 | Ahrndt et al. . | |
| 3,286,569 | 11/1966 | Hancock et al. . | |
| 3,299,925 | 1/1967 | McBrady et al. . | |
| 3,799,013 | 3/1974 | Long et al. . | |
| 3,799,019 | 3/1974 | Long et al. . | |
| 3,921,485 | 11/1975 | Tobey et al. . | |
| 3,969,966 | 7/1976 | Dillon . | |
| 4,043,238 | 8/1977 | van Ham . | |
| 4,428,263 | 1/1984 | Lindee et al. . | |
| 4,625,782 | 12/1986 | Jameson . | |
| 4,685,364 | 8/1987 | Scheflow et al. . | |
| 4,805,503 | 2/1989 | Yokokawa . | |
| 4,854,204 | 8/1989 | Faltin . | |
| 4,907,920 | 3/1990 | Lund et al. . | |
| 4,913,019 | 4/1990 | Hayashi | 83/437.1 |
| 5,065,656 | 11/1991 | Flisram . | |

(List continued on next page.)

FOREIGN PATENT DOCUMENTS

| | | |
|---|---|---|
| 243981 | 11/1987 | European Pat. Off. . |
| 595489 | 5/1994 | European Pat. Off. . |
| 8813952 | 2/1989 | Germany . |

*Primary Examiner*—M. Rachuba
*Assistant Examiner*—Sean Pryor
*Attorney, Agent, or Firm*—Cook, Alex, McFarron, Manzo, Cummings & Mehler, Ltd.

[57] ABSTRACT

Apparatus, device and method for improved slicing of large food sticks, loaves and the like are provided. A slicing blade which has a top flat surface or top flat land width along its cutting edge provides generally longitudinal forces on the food product being sliced, which forces are in a direction generally opposite to the direction through which the food products are fed through a slicing apparatus. The slicing blade includes a bottom primary bevel land width surface and an advantageous primary angle for imparting improved stack and slice uniformity and for controlling package overfill. The slicing blade also exhibits a long slicing blade surface which follows an Archimedean spiral. The invention is particularly important in improving handling of large luncheon meat sticks, especially non-frozen, high water content and reduced fat content luncheon meat sticks. Fast feed rates can be practiced without experiencing jamming, yields are increased, slice and stack quality and sizing are made more consistent and repeatable, slicing line utilization is enhanced, and sanitary conditions are more easily maintained.

19 Claims, 8 Drawing Sheets

U.S. PATENT DOCUMENTS 5,101,873 4/1992 Marshall .
5,136,908 8/1992 Callandrello .
5,282,406 2/1994 Ng .
5,291,815 3/1994 Reifenhauser .
5,301,577 4/1994 Flisram ..... 83/596
5,320,014 6/1994 Skaar et al. .
5,379,633 1/1995 Flisram et al. .
5,404,777 4/1995 Skaar et al. .

FOOD SLICING APPARATUS, BLADE AND METHOD

CROSS REFERENCE TO RELATED APPLICATION

This is a continuation-in-part of application Ser. No. 08/751,798, filed Nov. 18, 1996, which is a continuation of Ser. No. 328,213, filed Oct. 25, 1994, now abandoned, which is a continuation-in-part of application Ser. No. 213,494, filed Mar. 14, 1994, U.S. Pat. No. 5,404,777, which is a continuation of application Ser. No. 968,622, filed Oct. 29, 1992, U.S. Pat. No. 5,320,014.

DESCRIPTION

BACKGROUND AND DESCRIPTION OF THE INVENTION

The present invention generally relates to the slicing of food products and more particularly to a method and apparatus for conducting such slicing on food products such as large meat sticks. The invention involves feeding a meat stick or the like toward, into and through a slicer having a blade with specific attributes. The blade allows for slicing which is of improved quality consistency and carries out slicing operations which are of enhanced repeatability. Stacks of slices are formed which are of uniform height, shape, size and appearance. Meat sticks are thus handled even at particularly fast feed rates and without experiencing jamming, reduced yields, or poor slicing equipment utilization which are often experienced when slicing large meat sticks through industrial slicing machinery. Improved product slice and stack quality also results. The advantages of the invention are especially evident when the food sticks are of the low-fat and/or high water content types, especially when thinly slicing same at high speeds.

With certain products such as food products that are processed in large sticks, blocks, chubs, loaves or the like, it is often desirable to handle these large masses in any of the refrigerated but unfrozen, frozen or partially frozen states. Various reasons for processing under the latter two of such conditions include ease of manipulation of the sliced products so as to form neat stacks of slices due to the fact that frozen or partially frozen slices will present low friction interfaces with each other whereby they are readily moved into alignment. Refrigerated but non-frozen food products such as luncheon meats for example sever into slices which are difficult to mechanically move once one slice engages another slice or other surface, thereby rendering extremely difficult the neatening of stacks which are produced by conventional slicing equipment. Nevertheless, at times it becomes necessary to or avoid freezing. Unfrozen products can be difficult to slice at high speeds without causing damage to the slices, such as tearing and edge blow-out, and these difficulties are usually heightened when the food product stick has a high moisture content and/or a low or reduced fat content and/or when very thin slices are being produced.

Attempts have been used in the past for rapidly slicing these types of products and for forming these types of slices, but the yields have been disappointingly low and the waste has been greater than desired. Improvements in yields, stack uniformity and waste factors often can be gained by significantly reducing the feeding speed of the slicing apparatus. This results in increased labor costs and inefficient utilization of the slicing equipment when compared with the potential efficiencies of a truly efficient and high speed feeding approach.

An approach which has been attempted in seeking to capture the potential efficiencies of improved feed arrangements includes the use of a so-called orifice assembly. An orifice assembly is intended to support (primarily laterally) a food stick or the like as it passes through the slicer. Typically, an orifice assembly includes a cylindrical member or other member having a peripheral shape corresponding to that of the stick or the like being sliced. This cylindrical, oval or D-shaped member has a leading edge which is very closely spaced from the slicing blade and is intended to provide some support for the stick during slicing. Some approaches suggest using orifices having smooth inside surfaces, while others suggest somewhat irregular surfaces for contacting the sticks or the like. Pressure applied to the sticks can be adjusted in an effort to better hold the stick on its butt end; however, if too much pressure is applied, the hide can be squeezed off of the product by the orifice assembly, rendering the product unacceptable, while also experiencing uncontrolled butt end pull through subsequently resulting in product jams.

It has been found that the use of an orifice assembly or other type of support surface does not fully remedy the problems associated with high speed commercial product slicing, especially with respect to slice and stack consistency and quality, as well as butt end pull through, slicer jamming, disappointing yield and waste experiences. For example, typically about ½ inch to 8 linear inches, sometimes up to about 12 inches, of the butt end of the stick can be lost. Another consequence of frequent jams and pull through is associated with the need for an operator to interact with the slicer such as by using a hand to remove a jammed butt end, creating a condition that can lead to potential reduction of sanitary conditions, which can shorten the shelf life of the sliced products.

It has been found that by providing an improved slicing blade, significant improvements in slicing of food products, particularly luncheon meat sticks or loaves, are attained. By the approach in accordance with the present invention, the yield of uniform slices and stacks of high quality, commercially processable and packageable sliced product is enhanced considerably and the quantity of product waste is reduced significantly, even while achieving greater slicing speeds than those heretofore realized. Furthermore, operational characteristics and consistency of the slicing devices are enhanced.

More particularly, by proceeding in accordance with the present invention, it is possible to slice frozen, partially frozen or refrigerated but unfrozen food sticks on a truly efficient basis and at enhanced feed and slicing rates without incurring the inefficient and serious problems of slice tearing and/or jamming of the slicing equipment such as by having the slicing equipment pull a severed chub out of the orifice assembly as a large chunk of product that cannot be adequately handled by the slicing blade, resulting in jamming of the slicing equipment. Jamming, of course, necessitates a shut-down of the slicing line and perhaps associated machinery upstream and/or downstream of the slicing line in order to clear the jam, often requiring manual intervention by an operator, which can itself reduce the shelf life of the sliced product. Meat products which have high moisture contents and/or low fat contents and/or are not frozen throughout are especially difficult to slice at high speeds; nevertheless, uniform slices and stacks of even these products are consistently attained while still enhancing slicing speed and efficiency. Uniformity of slices includes elimination of ragged slices, folded slices, slices having uneven surfaces, and partial slices. Stack uniformity includes consistent stack height, avoidance of stack skew and so-called accordion sides. Enhanced throughput means less slicer clean out of damaged and partial slices and sticks.

In summary, the present invention achieves these objectives and provides advantageous results along these lines by processing large food sticks, loaves and the like at an exceptionally fast feed rate, with greater slice and stack uniformity and quality consistency and in a more repeatable fashion. The blade of the invention features a unique combination of features which brings about the advantages discussed herein, especially in providing undamaged and uniformly sized and shaped stacks and the slices making up the stacks. The cutting edge of the blade follows an Archimedean spiral pattern, and certain principal blade parameters embody criteria which regulate stack overfill, and minimize deviation from a desired stack height and which maximize the percentage of acceptable slices. These blade parameters include primary bevel angle, top land width, and primary bevel land width. Blade speed increases, which directly influence slice and stack properties, are achieved as a benefit of this combination of features.

It is a general object of the present invention to provide an improved blade, method and apparatus for slicing large food products in the form of sticks, chubs, loaves, chunks and the like.

Another object of this invention is to provide an improved slicing blade and method and apparatus which include the use of slicing blades having bevel angles, flat land width surfaces and flatness qualities which improve slicing quality, consistency and speed.

Another object of this invention is to provide an improved blade, method and apparatus for slicing food products in order to improve the yield of product processed through a slicer and is especially beneficial for product in a partially frozen or refrigerated and unfrozen state while accommodating relatively fast slicing speeds.

Another object of the present invention is to provide unusually uniform slicing and stacking of food stick slices even with thin slicing of high moisture, non-frozen, reduced-fat and/or low fat products.

Another object of the invention is to cleanly slice and uniformly stack refrigerated product (sliced above the freeze point of the product).

Another object of this invention is to provide an improved slicing apparatus, blade and method which combines blade cutting edge angle and surface width parameters with an Archimedean spiral shape along the blade length for achieving cutting speed throughout the product being sliced.

These and other objects, features and advantages of this invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
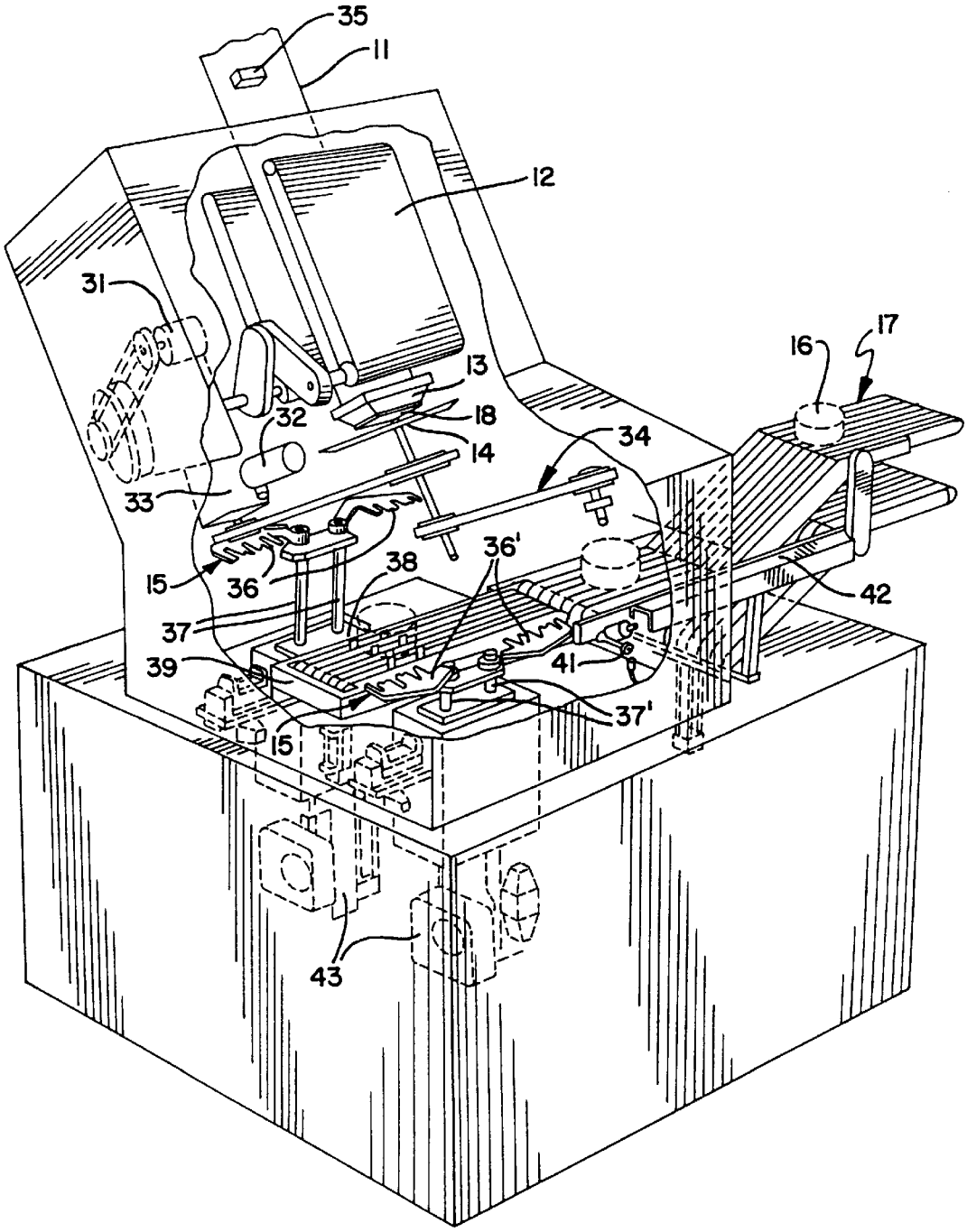
FIG. 1 is a perspective view, partially broken away, of a type of slicing apparatus within which a blade according to the present invention may be incorporated.

An apparatus for feeding food sticks, rolls, loaves, chubs, chunks or the like, for severing same into slices, and for collecting the slices into a plurality of stacks is generally shown in FIG. 1. This is illustrative of the type of apparatus within which blades according to the invention may be incorporated. A stick of product 11 is generally shown within a feeding assembly 12 of generally known construction, further details of the illustrated feeding assembly 12 being shown for example in FIG. 5 of U.S. Pat. No. 5,320,014, incorporated by reference hereinto. Each stick 11 food product is fed by the feeding assembly 12 to an orifice assembly 13 in this particular apparatus. The fed food product is brought into engagement with a slicing blade 14. Product slices accumulate on a catcher assembly, generally designated as 15. Sliced stacks 16 collect on a conveyor assembly, generally designated 17.

Figure 2:
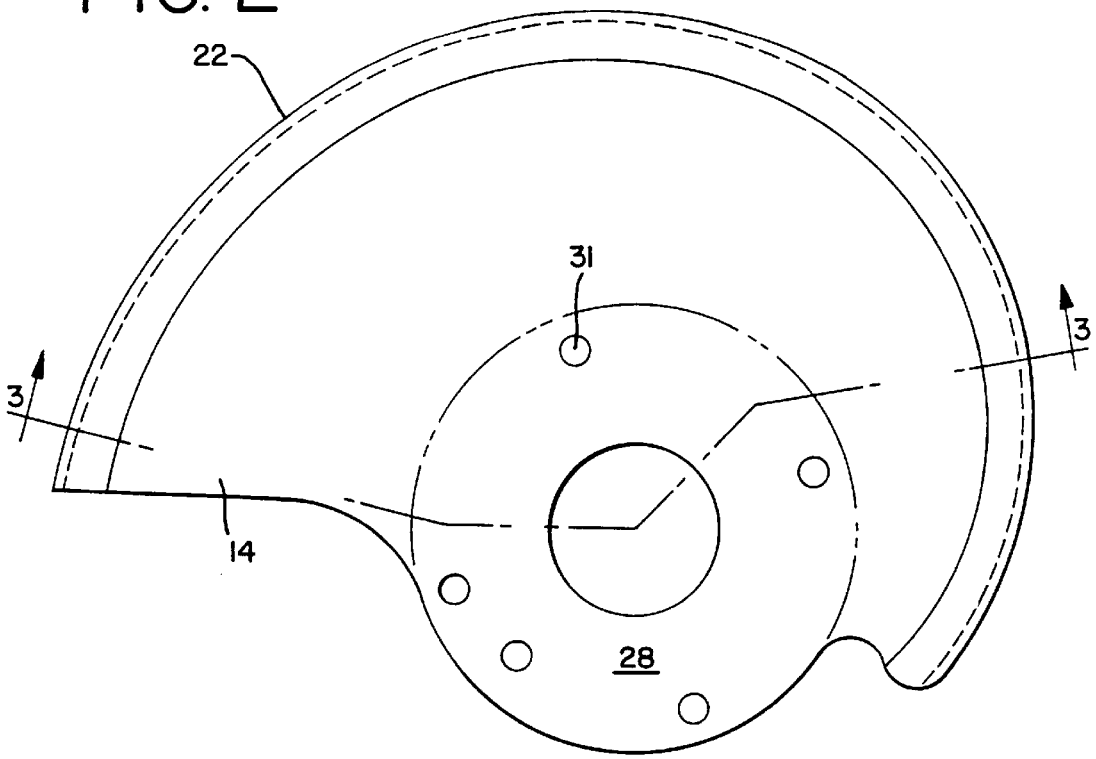
FIG. 2 is a plan view of a typical slicing blade.
Figure 3:
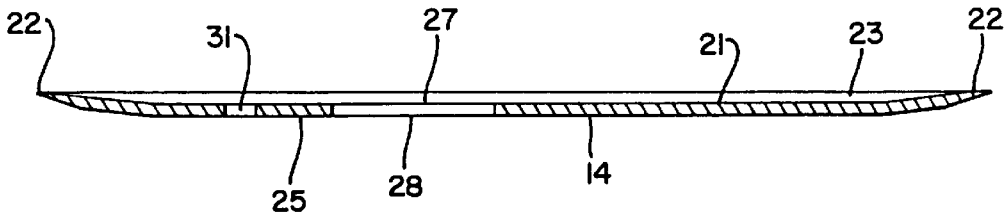
FIG. 3 is a cross-sectional view taken along line 3—3 of the blade illustrated in FIG. 2.
Figure 4:
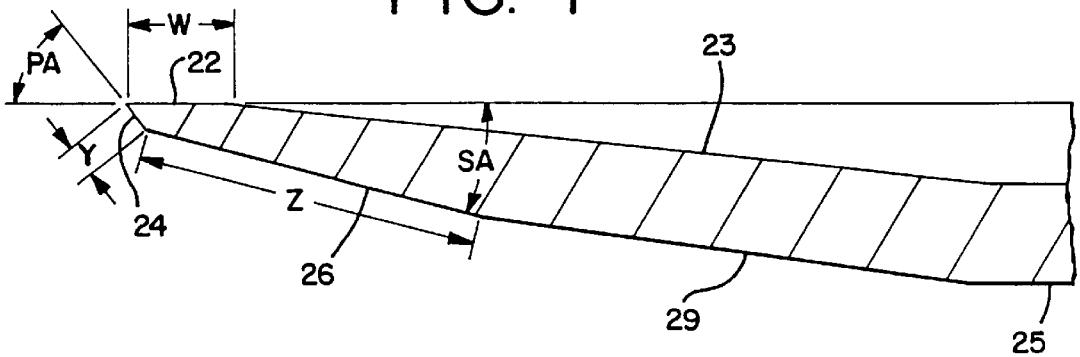
FIG. 4 is an enlarged view of the working edge of the blade shown in FIG. 2 and FIG. 3.

Stick 11 is severed by slicing blade 14 at a location closely adjacent to and only slightly spaced from lip 18 of the illustrated orifice assembly 13. As illustrated in FIGS. 2 through 4, working side 21 of the slicing blade 14, which is the side of the blade that faces food product 11 during the slicing operation, includes a body portion and a flat top surface or top flat land width 22 which is virtually parallel to the cut surface of the food product 11 being sliced. Body portion of working side 21 of the slicing blade 14 is generally dish-shaped or somewhat concave whereby a clearance area 23 (FIGS. 3 and 4) is provided between the food product 11 being sliced and the slicing blade 14, particularly the body portion of its working side 21, while the top flat land width 22 is in contact with the food product 11 as it is being sliced. The formation of a slice, including the interaction between the food product 11 and the various surfaces of the edge portion of the slicing blade 14 includes having the slice eventually thrown by the blade 14 slicing through the food stick 11.

Edge portion of the slicing blade 14 is shown in greater detail in FIG. 4. The top flat surface or top flat land width 22 is in the nature of a flat band that has an average width "W" which is very uniform along the cutting edge. It will be appreciated that top flat surface 22 is formed by a grinding operation. Because of the relatively large periphery and relatively thin thickness of the slicing blade 14, it is difficult to provide a top flat surface 22 that is of uniform width throughout its extent. The average width "W" is determined by measuring the width of the top flat surface 22 a plurality of times, the measurements being one inch apart along the extent of the top flat surface 22. These measurements are then totaled and divided by the number of measurements in order to obtain the average width. In order that the top flat surface 22 provides adequate support to hold the food product 11 during slicing, the average width should be between about 0.1 inch and about 1 inch along the cutting surface. A typically preferred average width is between about 0.1 inch and about 0.5 inch. Generally preferred is an average width of 0.150 inch, ranging between about 0.1 inch and about 0.2 inch, an especially preferred width being 0.150 inch ±0.030 inch. The blade of the invention exhibits reduced pull on the food sticks during slicing, when compared with other slicing mechanisms.

Also included is a primary bottom bevel surface or primary bevel land width 24 at the primary angle. The top flat land width 22 and the bottom primary bevel land width surface 24 intersect each other at a primary angle "PA". The back side 25 of slicing blade 14 includes a secondary bevel surface 26 or bottom land width at the secondary angle.

Primary bevel land width surface will typically have an average width "Y" which ranges between about 0.030 inch and about 0.120 inch, preferably between about 0.040 inch and about 0.110 inch, and most especially between about 0.050 inch and about 0.085 inch, a particularly preferred width being about 0.070 inch ±0.010 inch. A range for the primary angle "PA" is at least about 28° and less than about 50°. It has been found to be important that this primary angle be moderately steep, preferably between about 30° and about 40°, a particularly preferred primary angle PA being about 30 °±1°, with an even tighter range being 30°±0.50°.

The secondary bevel surface 26 has a width "Z" of between about 1 inch and 2 inches, typically between about 1.25 inch and about 1.75 inch, preferably about 1.5 inch ±0.030 inch. The angle of the secondary bevel surface 26 with respect to the top surface or flat top surface 22 of the blade, or the secondary angle "SA", is typically between 0° and about 30°, preferably between about 10° and about 20°, an especially preferred angle being about 15°±1°. It will be appreciated that the actual values of these parameters may vary somewhat depending upon the product being sliced.

Also of substantial importance to the principles of the invention is a flatness characteristic of the slicing blade 14. In essence, substantially the entirety of at least the cutting edge of the blade lies along substantially the same flat plane such that no portion of the cutting surface varies (with respect to such plane) from any other portion of the cutting surface by a distance greater than 0.150 inch. In other words, the flatness tolerance for the working surface of the slicing blade is 0.150 inch from a precise parallel condition. This tolerance typically should be equal to or less than about 0.050 inch, preferably equal to or less than about 0.015 inch, most preferably equal to or less than about 0.010 inch.

In addition, the mounting hub or portion of the blade, at both its front or top surface 27 and its back or bottom surface 28, is preferably ground flat and parallel to the working surface of the blade. This assures that the blade, when properly mounted within a slicing apparatus, will present its cutting surface in a "square" or "true" manner whereby the cutting surface of the rotating blade will remain in virtually the same plane and will not exhibit any appreciable unevenness of motion while the blade is rotating.

Slicing blade flatness also contributes greatly to the ability to form blades having the bevel and land surface widths and the bevel angles which are specified herein and to hold those parameters within the specified ranges throughout the cutting length of the blade.

Blade 14 typically includes a tertiary bevel surface 29. Generally speaking, its width and the value of the tertiary angle which it defines will be determined by the other parameters of the blade. Typically, the tertiary angle will be shallower then each of the primary angle PA and secondary angle SA. Often, the width of tertiary bevel surface 29 will be greater than each of the primary bevel surface 24 and secondary bevel surface 26. Each mounting hole 31 will be drilled perpendicular to the surface and suitably sized and spaced depending on the slicing equipment within which the blade is to be mounted.

Each blade is honed or sharpened to have a good sharpness rating. For example, a sharpness measurement device will engage the working edge of the blade at about four different locations or intervals, excluding the first inch and last inch of the cutting surface. When using a measurement device or sharpness meter as disclosed in U.S. Pat. No. 5,379,633, incorporated hereinto by reference, the average of the four readings should be 3.2 pounds or less, preferably 2 pounds or less. After honing or sharpening, the widths of the various bevel surfaces are checked, typically while excluding measurements along the first inch and last inch of the cutting surface.

The advantageous effect of the combination of the present invention includes the momentum imparted to each slice as the blade cycles entirely through the food stick 11 and the slicing blade 14 slices entirely through the stick of meat 11 by the time the longest leg of the blade 14 has rotated into the food stick 11. Once the blade has rotated through its slicing phase, as well known in the art, the slice 19 is completely severed from the food stick 11.

The combination of features of the slicing blade 14 cooperate to cleanly slice and to rapidly and accurately throw down each slice into a well-aligned stack of slices, each stack being of a uniform height for a given number of slices. Thus, slices prepared according to the invention, when compared with previous approaches, have particularly vertical and flat side surfaces, which stacks are made of uniformly sized and shaped slices which control stack height to within tight height ranges.

Another instance of advantageous aspects of the combination is that the flat top surface or top flat land width 22 provides a superior holding force upon the food stick 11. Similarly, a force is applied onto the food stick 11 by the orifice assembly 13 in a direction substantially normal to the holding force imparted by the top flat land width. It is believed that these forces combine to enhance the advantages achieved by the present invention. It was observed, for example, that these forces support even the butt end which remains during the slicing of a food stick whereby same is sliced more thoroughly than practiced heretofore. Moreover, this is accomplished even in those instances where the butt end is engaged by and is pushed into the slicing device by a following food stick which is within the feeding assembly 12. In accordance with the present invention, the slicing blade 14 contacts the food stick 11 and remains in contact with it for a length of time greater than accomplished heretofore. It is important that the flat top surface 22 have an average surface area or width which is adequate to support the product in achieving this advantage of the invention.

The downward force imparted to the food stick 11 and/or food butt 29 by the primary bevel angle "PA" is controlled by the invention. Otherwise, this downward force can result in uncontrolled movement of the food product during slicing, particularly when that food product is a butt end 29. This uncontrolled movement results in lower slicing yields, slicer jam-ups, poor slicing line utilization, and a potentially reduced shelf life for the sliced products. Problems of these types at times occur in commercial slicers such as illustrated generally in FIG. 1 which are sold commercially by Formax, Inc. for continuous slicing and which experience these difficulties including butt pull-through and poor slice quality. To a certain extent, these difficulties can be reduced by reducing the speed of operation of the slicing equipment, which, of course, is an example of poor slicing line utilization.

The invention is especially advantageous because it can accommodate even fragile, soft products which can have relatively high water contents. Examples include chicken, smoked turkey, ham and low-fat, reduced-fat and/or relatively high water content versions of these meats and others. It is often desirable to slice same when at refrigerated, but higher in temperature than frozen, temperatures; usually these meat sticks would be at a temperature between about 24° F. and about 36° F. While the invention can also be suitable for frozen or partially frozen sticks at a temperature equal to or less than about 22° F., typically between about 10° F., and about 22° F., often between about 16° F. and about 22° F., the invention is especially advantageous for slicing sticks which are above the product freeze point. For many meat slices, the freeze point is about 24° F., and a good slicing temperature in this regard is about 26° F. to about 20° F. for such products. Unfrozen products at an internal temperature at or above 30° F. can also be very advantageously sliced in accordance with the invention.

Depending upon the makeup of the stick and the conditions under which it was subjected to a low temperature environment, a stick could be of generally uniform temperature throughout or could be lower in temperature at its rind or crust, which is often preferred, or at its center, for example. Thus, these temperatures will vary somewhat depending on actual conditions and products.

With respect to the types of slicing mechanisms and blades therefor, the present invention is especially beneficial when slicing blade 15 is of a spiral type, which follows a so--called Archimedean spiral along the active cutting surface of the blade. Such a cutting edge profile contributes to slicing speed increases and to significant quality improvements, especially when combined with the other features discussed herein. For example, Formax slicing equipment (as generally shown in FIG. 1) has not allowed slicing beyond about 650 to 800 RPM (or slices per minute) with higher water content meat sticks above their freeze point. With the use of blades having the Archimedean spiral cutting edge profile, as well as other features as described herein, cutting speeds of about 1000 slices per minute and above, up to the speed capacity of the slicing equipment (typically at or approaching 1400 RPM or above), have been achieved on a consistent and regular basis.

Figure 5:
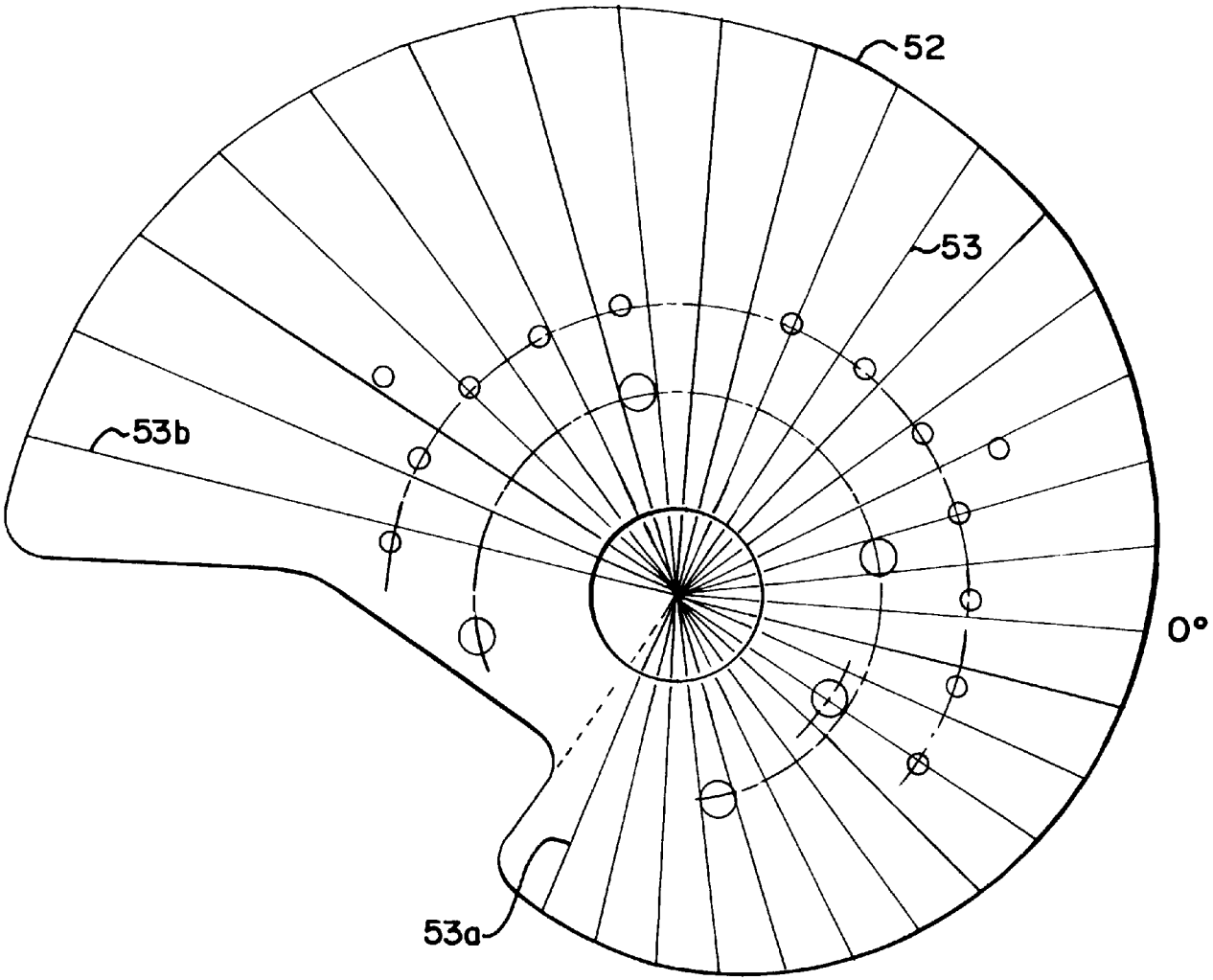
FIG. 5 is a plan view of a preferred blade profile.

An Archimedean spiral is defined as a plane curve generated by a point moving away from a fixed point at a constant rate while the radius vector from the fixed point rotates at a constant rate. The distance, or radius, between the fixed point and the curve thus varies consistently along the curve from its smallest radius to its largest radius. A blade of this type is shown in FIG. 5. Edge 52 follows an Archimedean spiral. A plurality of radii 53 are illustrated, ranging in length between radius 53*a* and radius 53*b*, with intermediate radii having respective lengths between those of radii 53*a* and 53*b*. Each radius is generated in accordance with the equation $r=K(n°)+J$, where r is the radius and n° is the angle generated between a fixed radius, such as the radius 43*a*, and the radius being calculated. K is a constant which is selected to dictate the rate of radius change, and J is a different constant which is other than zero when it is desired to displace the radii from the radial center. The n° component is in degrees or radians, and each constant K, J is selected depending upon the size and nature of the product being sliced and the total length of the edge 52, for example.

Figure 6:
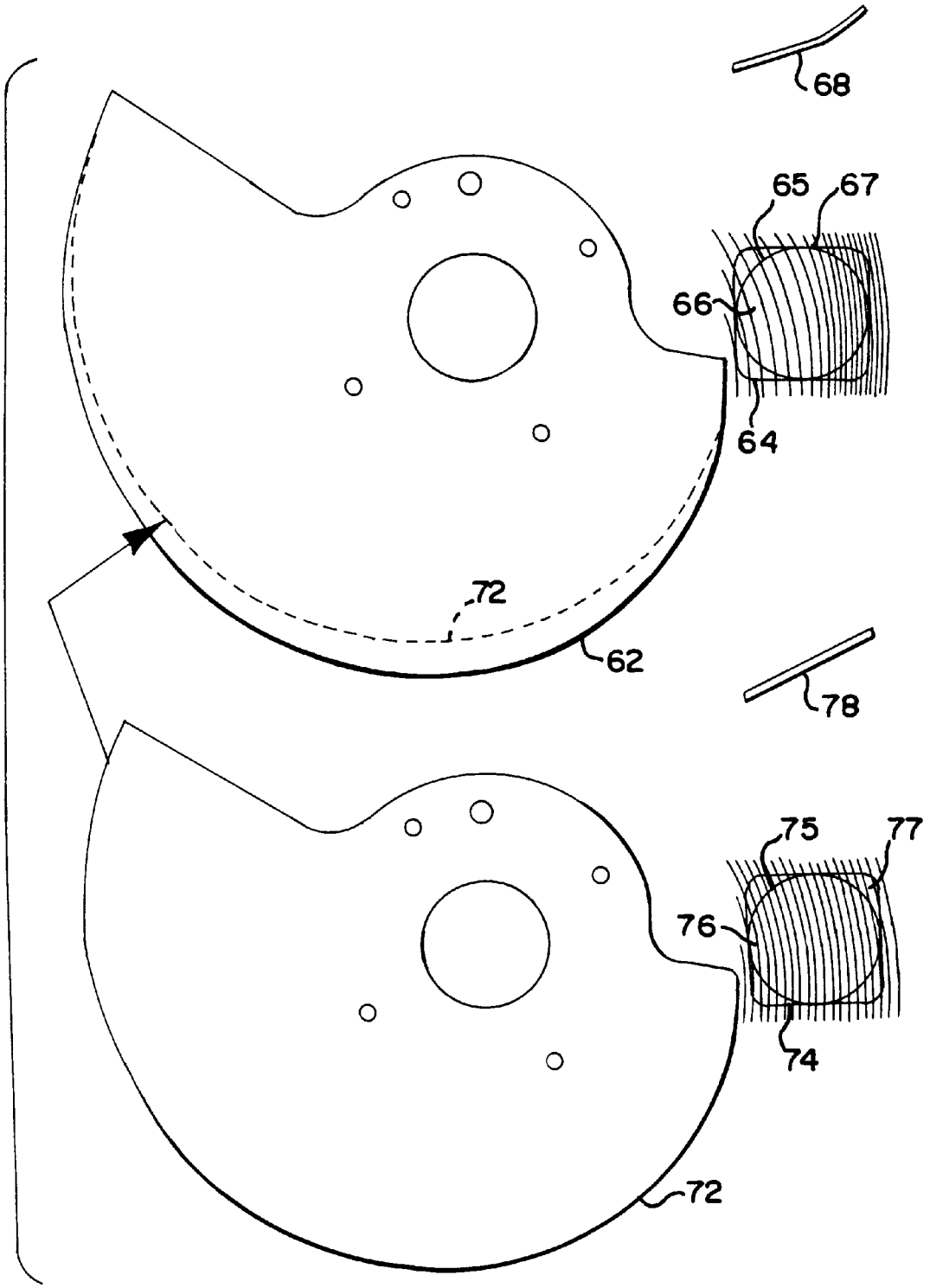
FIG. 6 schematically represents cutting speed properties of certain blade profiles.

With this Archimedean spiral characteristic, the blade cutting edge 52 moves through the stick with a uniform cutting speed. The blade exhibits uniform lateral movement, with the blade moving through each section of each slice at a uniform speed. This can be characterized as two-dimensional uniform speed movement both across and through the stick which is in the nature of a movement across each slice in the direction of blade rotation and radially through each slice. The slicing action is uniform speed slicing which is both tangential to and perpendicular to the cutting edge of the blade throughout the cutting arc. FIG. 6 generally illustrates a multiple-arc non-Archimedean blade profile 62, while an Archimedean profile 72 of the same general size and length also is shown both on a separate blade and interposed over the non-Archimedean blade 62.

With further reference to FIG. 6, sticks 64, 65 are schematically shown being sliced by blade profile 62. Each curve superimposed thereover represents speed through the stick. For example, curve 66 represents a speed faster than curve 67. In other words, curves 66 and 67 represent respective lengths of slicing action which are achieved during a given fraction of cutting duration. Curve 66 severs more product during this fraction than does curve 67. Sticks 74, 75 are schematically shown being sliced by Archimedean spiral profile 72. Speed curves 76, 77 are spaced from each other by a constant amount, and each curve represents uniform fractional stick severance. It will be noted this uniformity proceeds through the slicing action. This uniform slicing action is illustrated by aggressiveness plot 78, while aggressiveness plot 68 depicts the non-uniform slicing action of non-Archimedean spiral profile 62.

It can be desirable to coat any of these blades with materials that have a lower coefficient of friction than, for example, stainless steel, in order to reduce drag between the blade and the product being sliced. This can enhance the neatness of the stacks initially made by the slicer. Coatings can also increase the working life of the blade between needed sharpenings and can also retard rusting and/or corrosion. A typical coating in this regard is or includes titanium nitride.

FIG. 1 illustrates one of the types of slicing devices that can advantageously practice the present invention. A known blade driving mechanism, partially broken away, is illustrated as including a feed encoder 31, a stepping motor 32, a variator 33, and drive components generally designated 34 including a brake mechanism. A sensor or switch 35 is provided for detecting the location of sticks 11 passing through the feeding assembly 12.

Catcher assembly 15 includes a plurality of stacking grids or indexing platforms 36, 36'. The stacking grids 36, 36' move between the up position of the backside grids as shown in FIG. 1 and the down position of the front side grids 36'. Also, the grids 36, 36' rotate along the respective axes of their support rods 37, 37' so that one of the pairs of grids is out of the travel path of the slices while the other pair of grids is receiving the stack being formed and moving toward depositing the formed stack onto protruding pins 38 which typically serve as a platform for a scale mechanism. A scale conveyor 39 operates in a generally known manner by pivoting an axis 41 to thereby lift a formed stack off of the protruding pins 38 in order to convey same onto downstream conveyor assembly 42.

Grid encoders 43 assist in the operational timing of the unit. An adjusting mechanism is available for modifying the pressure exerted on the stick 11 by the orifice 13. Generally speaking, orifice 13 includes components, such as split halves, which move laterally with respect to the stick in order to thereby modify the pressure applied by the orifice assembly 13 in a generally known manner.

Concerning the method in accordance with the invention, the food stick is sliced in a very consistent and controlled manner and at fast slicing speeds which will vary somewhat depending upon the particular slicing equipment being used. Slicing speeds in excess of 800 slices per minute are readily achieved while effecting exceptionally reproducible slicing. Included are speeds of up to the maximum slicing speed of the particular slicer, which can be 1400 or more slices per minute. These speeds vary depending upon the slicing equipment and the food product being sliced. In any event, the speed is significantly greater for blades according to the invention when compared with prior art blades when slicing the same product under the same conditions. In addition, product tears are fewer and slice quality is better when the present blades are utilized.

The present invention also allows for the formation of freshly sliced stacks which exhibit a consistent height from stack to stack. When these stacks are prepared to be used in packaged products, the invention achieves a minimization of product overfill variation, thus allowing a closer tolerance of intentional overfill to assure packages which are not under weight while reducing total poundage of overfill above stated weights.

The method includes having the top flat surface impart generally longitudinally directed support of the stick during slicing, while the bottom primary bevel land width surface and the primary angle effect a step of angularly engaging the food stick being sliced so as to cause each slice to be thrown downwardly at a deposit angle which is typically slightly less than the primary angle. The bottom profile of the blade also cooperates with the rest of the blade to achieve the advantageous results discussed herein. Also included are the use of the Archimedean curve blade profile.

Another advantage of the invention and method is the ability to slice in a consistent and fast manner any variety of food products such as large luncheon meat sticks. They may be frozen, partially frozen or refrigerated and unfrozen. The advantages of the invention are realized even when particularly difficult to slice meat sticks are handled. For example, the method readily handles slicing of meat sticks of the low fat or reduced fat varieties, such as those having fat contents at 10 weight percent or below, based on the weight of the stick, or at 5 weight percent and below, and even as low as 2 weight percent and below. So called no-fat meat products, which can have a fat content of 1 weight percent or below, are also successfully sliced in accordance with the invention.

Also food products or sticks that are formulated in taste-enhancing fashion such as by having relatively high water contents, for example at about 75 weight percent and above, are efficiently and rapidly sliced into slices of high consistency in slice thickness and/or weight and with reduced tearing, formed into stacks of uniform height and smooth-sided shape, when compared with blades not incorporating the features of the invention.

FIGS. 7, 8, 9 and 10 are useful in illustrating certain of the advantages and features of the invention. They plot data generated from blades made in accordance with the invention including the blade edge parameters and the Archimedean spiral shape.

Figure 7:
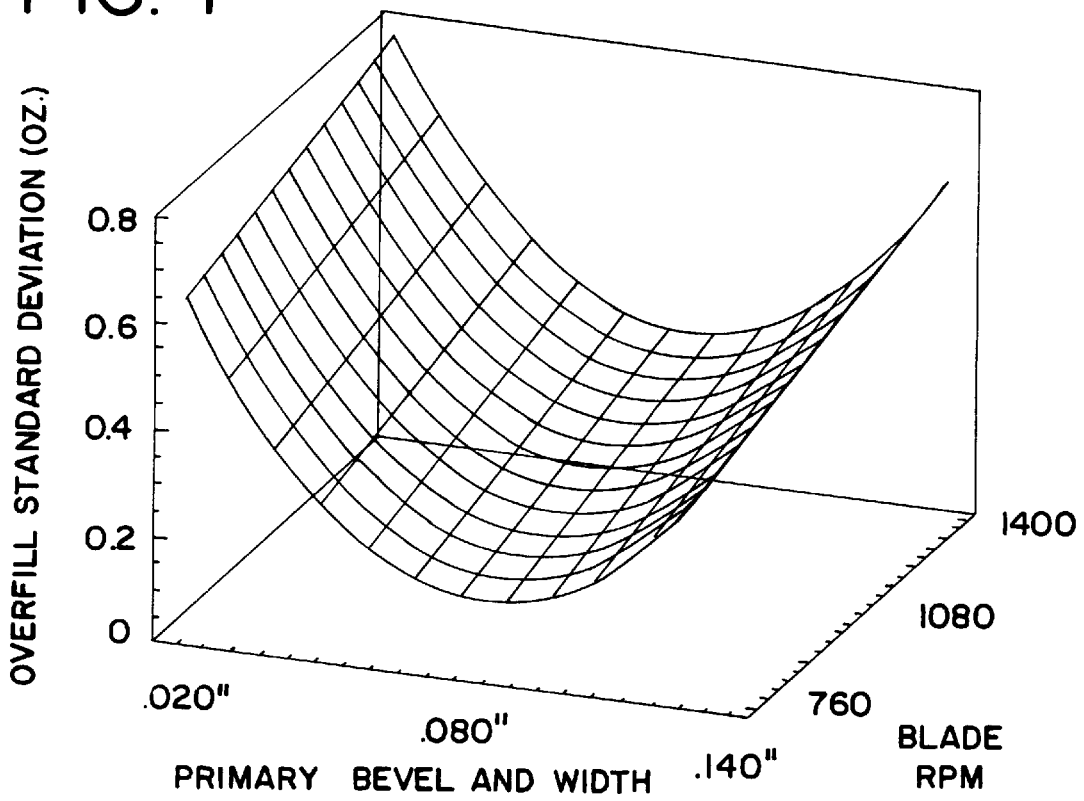
FIG. 7 is a three-dimensional contour plot illustrating enhanced overfill properties.

FIG. 7 is a three-dimensional contour plot illustrating the impact of certain variables on package overfill. Overfill standard deviations (in ounces) for slicing of fat free chicken are plotted on the vertical axis. A lower standard deviation indicates lower overall overfill (and thus overall savings in product). Blade speed, in RPM or slice-per-minute values, is plotted along one of the horizontal axes, while primary bevel land width (Y in FIG. 4) is along the other horizonal axis. It will be noted that an increase in blade speed tends to increase overfill standard deviation, while this negative effect is lessened when the primary bevel land width is within the preferred ranges noted herein.

Figure 8:
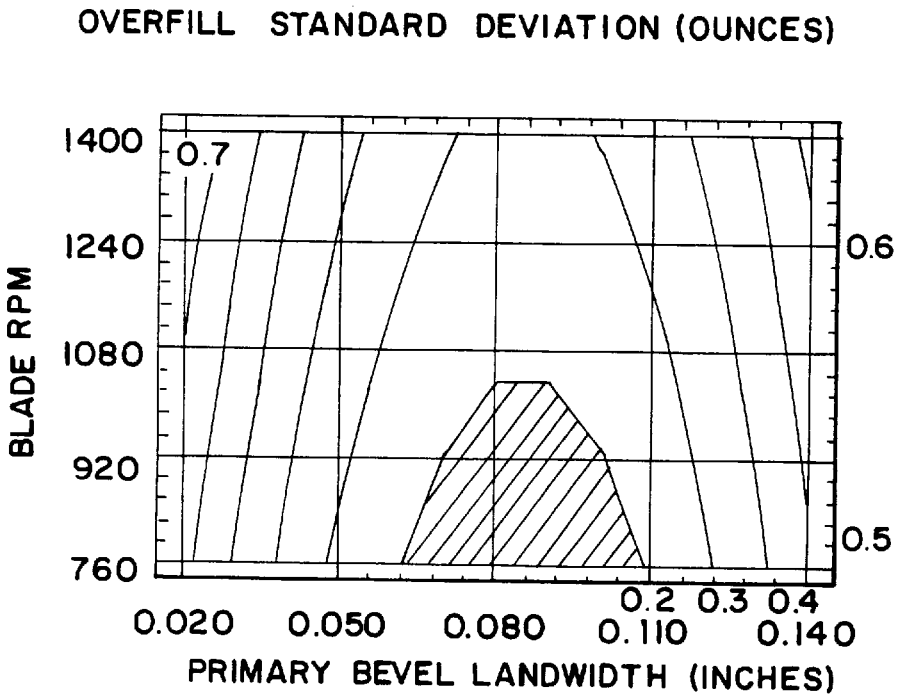
FIG. 8 is a two-dimensional contour plot taken from FIG. 7.

In FIG. 8, the plot of FIG. 7 is reported as a two-dimensional contour plot. The cross-hatched area delineates preferred operational parameters and the fact that excellent overfill control is achieved with blades according to the invention at slicing speeds on the order of 1000 RPM. Very acceptable overfill control (0.2 ounce standard deviation) is achieved at speeds up to 1240 RPM, while still acceptable overfill control (0.3 ounce standard deviation) is achieved at 1400 RPM.

Figure 9:
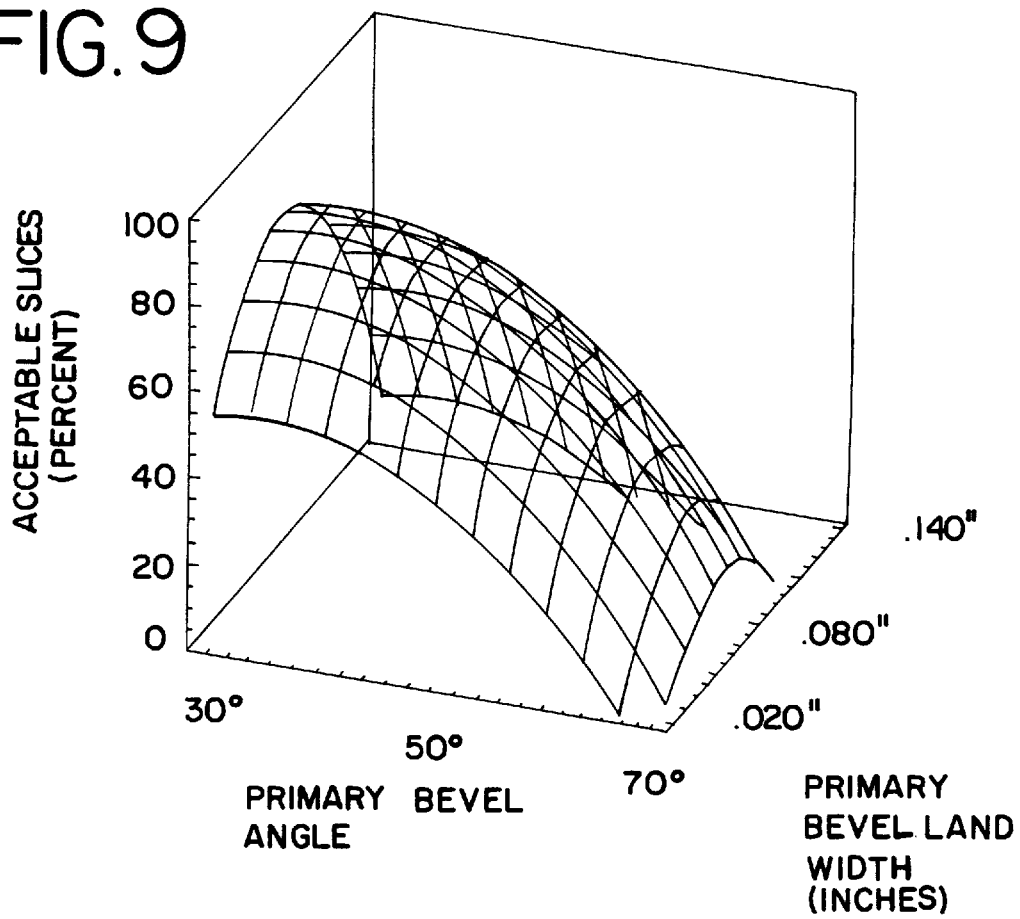
FIG. 9 is a three-dimensional contour plot illustrating enhanced slice acceptability.

FIG. 9 is a three-dimensional contour plot illustrating the impact of the features of the invention on percent of acceptable slices of fat free chicken. Percent of acceptable slices (and thus slice quality, uniformity and absence of damage such as tearing, ragged edges, blown edges, partial slices and non-flat surfaces) are plotted on the vertical axis. Primary bevel land width (Y in FIG. 4) is along one horizontal axis, while the primary bevel angle (PA in FIG. 4) is plotted along the other horizontal axis. It will be noted that the values of the invention on these Archimedean spiral blades achieve the highest acceptable slice percentages.

Figure 10:
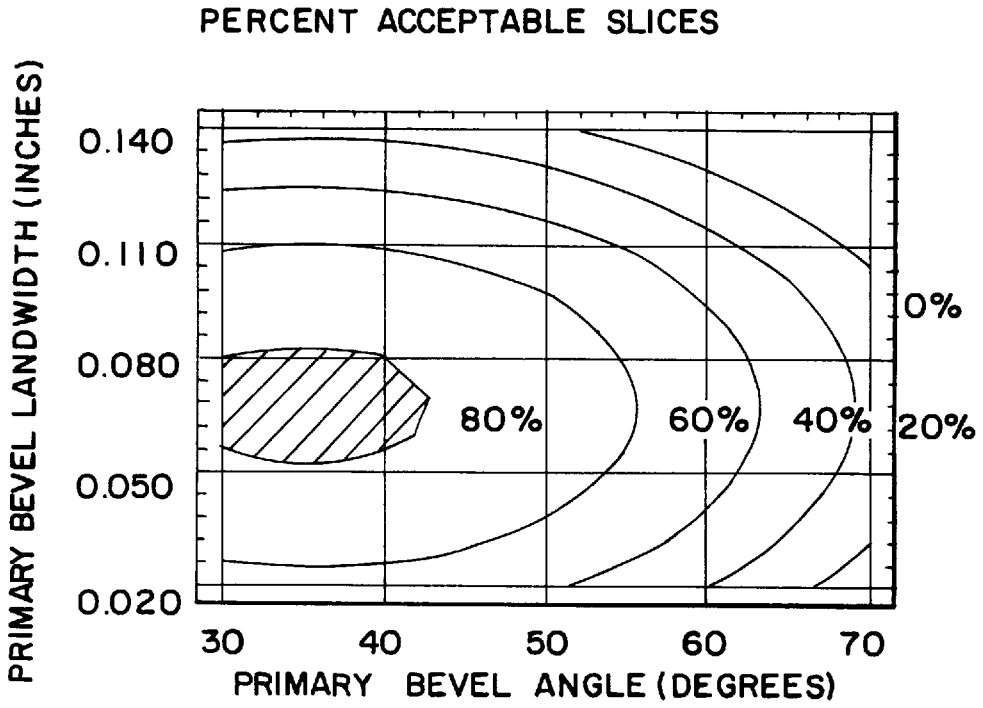
FIG. 10 is a two-dimensional contour plot taken from FIG. 9.

In FIG. 10, the plot of FIG. 9 is reported as a two-dimensional contour plot, and the cross-hatched area delineates especially preferred blade parameters and the fact that the highest percentages of acceptable slices are achieved with blades according to the invention. In addition, these plots are for the relatively fast blade speed of 1240 RPM. Such a speed represents a substantial increase over prior commercial slicing experience. For example, for a single luncheon meat product, the savings with a blade according to the invention are on the order of several tens of thousands of dollars per million pounds of sliced product.

Figure 11:
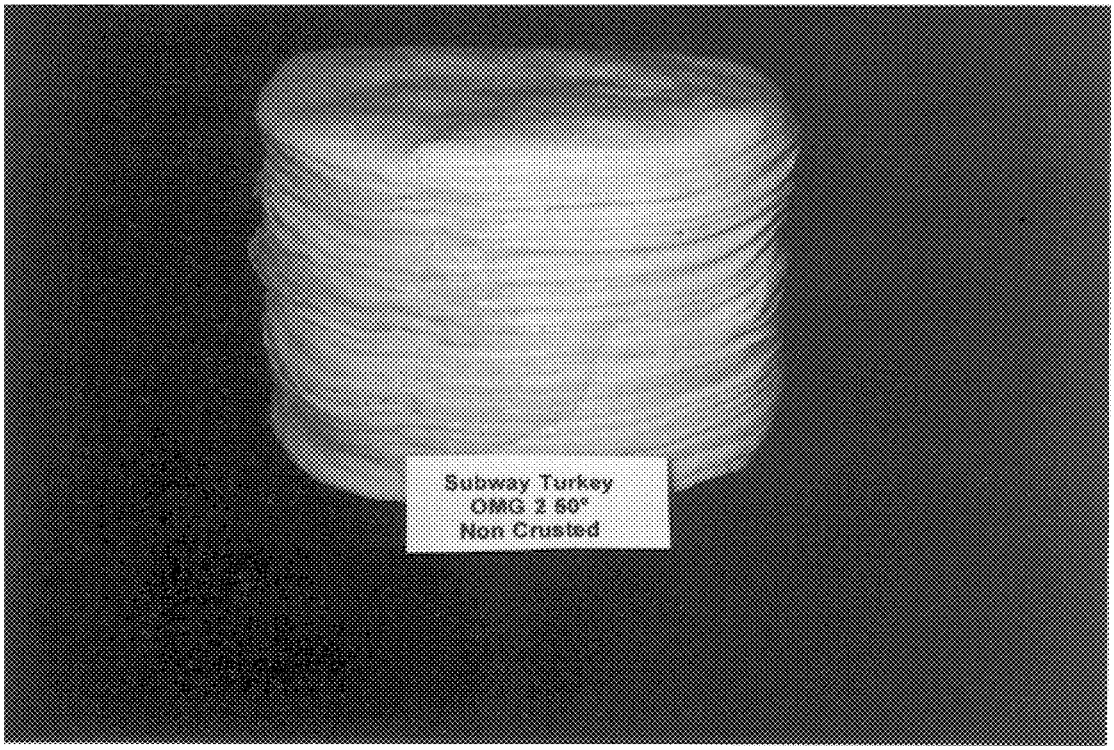
FIG. 11 and FIG. 12 are reproductions of photographs of slice stacks illustrating stack uniformity enhancement according to the invention.
Figure 12:
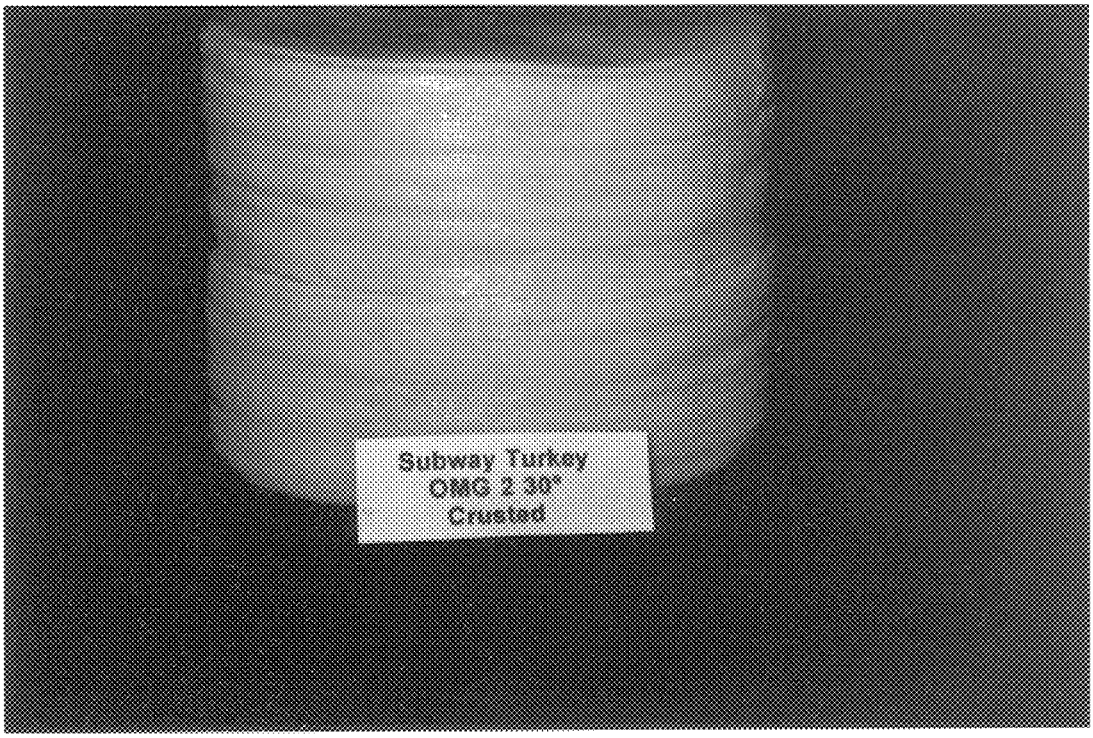

FIG. 11 gives a photograph report of a stack of slices having an uneven stack characteristic. This stack was made with an Archimedean spiral blade having a primary bevel land width of 0.060 and a primary bevel angle of 50°. This stack can be described as accordion-shaped. FIG. 12 provides a photographic report of a stack of slices having a very desirous stack shape. This stack was made with an Archimedean spiral blade having a primary bevel land width of 0.070 inch and a primary bevel angle of 30°.

It will be understood that the embodiments of the present invention which have been described are illustrative of some of the applications of the principles of the present invention. Numerous modifications may be made by those skilled in the art without departing from the true spirit and scope of the invention.

We claim:

1. An apparatus for slicing food sticks, comprising:

a slicing assembly for severing large sticks of food products into slices and stacking said slices into stacks of slices;

means for feeding a food stick to the slicing assembly;

an orifice for receiving and generally laterally supporting a leading portion of said food stick during slicing, said orifice having an opening through which said food sticks pass;

said slicing assembly has a blade member, said blade member engages said food stick and severs said food stick into said slices, said blade member having a generally concave, non-severing body portion and a severing edge portion, said severing edge portion having a flat portion radially projecting beyond said non-severing body portion and defining an outermost perimeter severing edge of said edge portion;

said orifice being located upstream of said blade member;

said outermost perimeter severing edge having a severing profile which follows an Archimedean spiral pattern having a plurality of adjacent radii which increase at a constant rate;

said flat portion of the severing edge portion of the blade member is a top flat surface which engages said food stick and is generally parallel to the cut surface of the food stick being sliced, said top flat surface having an average width adequate to impart a holding force to generally longitudinally support said food stick which it engages when said blade member severs the food stick into slices, said average width of the top flat surface being not less than about 0.1 inch;

said edge portion further having a bottom primary bevel land width surface which has an average width of between about 0.030 inch and about 0.120 inch, said bottom primary bevel surface and said flat top surface together define a primary angle, said primary angle being between about 28° and about 45°; and said orifice and said top flat surface combine to engage and support the food stick during slicing, said orifice laterally supporting the leading portion of the food stick and said top flat surface simultaneously supporting, in a direction generally perpendicular to the lateral support by the orifice, the surface of the food stick being cut.

2. The apparatus in accordance with claim 1, wherein said primary angle is between about 29° and about 35°.

3. The apparatus in accordance with claim 1, wherein said primary angle is about 30°±1°.

4. The apparatus in accordance with claim 1, wherein said bottom primary bevel land width surface has an average width of between about 0.050 inch and about 0.085 inch.

5. The apparatus in accordance with claim 1, wherein said bottom primary bevel surface has an average width of about 0.070 inch±0.010 inch.

6. The apparatus in accordance with claim 1, wherein said primary angle is between about 29° and about 40°, said bottom primary bevel land width surface has an average width of between about 0.040 inch and about 0.110 inch, said average width of the top flat surface is between about 0.1 inch and about 0.2 inch, said blade member further includes a bottom secondary bevel surface located radially inwardly of said bottom primary bevel surface, and said bottom secondary bevel surface defines, together with said top flat surface, a secondary angle of between about 0° and about 30°.

7. A slicing blade for slicing food sticks, comprising:

a generally concave non-severing body portion for mounting the slicing blade onto a slicing apparatus;

a severing edge portion extending in a generally peripheral manner from said body portion;

said severing edge portion has a top flat surface radially projecting beyond said generally concave non-severing body portion and defining an outermost perimeter edge of said severing edge portion;

said severing edge portion having a severing profile which follows an Archimedean spiral pattern having a plurality of adjacent radii which increase at a constant rate;

said top flat surface engages a food stick sliced by the blade so as to be generally parallel to the cut surface formed while the food stick is being sliced, said top flat surface having an average width adequate to impart a holding force to generally longitudinally support the food stick which it engages when the blade member severs the food stick into slices, said average width of the top flat surface being equal to or greater than about 0.1 inch;

said edge portion has a bottom primary bevel land width surface which has a width along its entire length that is between about 0.030 inch and about 0.120 inch, said width of the bottom primary bevel surface being not greater than said width of the top flat surface; and said bottom primary bevel surface, together with said top flat surface, defines a primary angle, said primary angle being between about 29° and about 35°.

8. The slicing blade in accordance with claim 7, wherein said primary angle is about 30°±0.5°.

9. The slicing blade in accordance with claim 7, wherein said bottom primary bevel surface has an average width of between about 0.050 inch and about 0.085 inch.

10. The slicing blade in accordance with claim 7, wherein said edge portion further includes a bottom secondary bevel surface located radially inwardly of said bottom primary bevel surface which, together with said top flat surface, defines a secondary angle, and said secondary angle is between about 0° about 30°.

11. The slicing blade in accordance with claim 10, wherein said secondary angle is between about 10° and about 20°.

12. The apparatus in accordance with claim 1, wherein said food stick which is fed by the means for feeding and which is engaged and severed by said blade member has a temperature between about 24° F. and about 36° F., which temperature is at or above the freeze point of the food stick.

13. The apparatus in accordance with claim 1, wherein said food stick of said means for feeding and which said blade member engages and severs is unfrozen and at an internal temperature equal to or greater than 30° F.

14. The apparatus in accordance with claim 1, wherein said radii of said Archimedean spiral pattern are defined by the formula $r=K(n°)+J$, wherein r is each radius defining the spiral, n° is the angular displacement of each radius from a reference radius, K is a constant rate at which the spiral radii increase, and J is a constant length representing displacement from blade center.

15. The apparatus in accordance with claim 6, wherein said secondary angle is between about 10° and about 20°.

16. The apparatus in accordance with claim 1, wherein said food stick of the means for feeding is a large stick of luncheon meat having a high water content of at least about 70 percent by weight, based on the weight of the stick.

17. The apparatus in accordance with claim 1, wherein said food stick of the means for feeding is a large stick of luncheon meat having a fat content of about 10 percent by weight or less.

18. The apparatus in accordance with claim 1, wherein said food stick of the means for feeding is a large stick of luncheon meat which has a high water content of at least about 75 percent by weight and a low fat content of about 2 percent by weight or less.

19. The apparatus in accordance with claim 1, wherein said food stick of the means for feeding is a large stick of luncheon meat having a fat content of about 2 percent by weight or less.

* * * * *

UNITED STATES PATENT AND TRADEMARK OFFICE

CERTIFICATE OF CORRECTION

PATENT NO. : 5,988,033

DATED : November 23, 1999

INVENTOR(S) : Gary R. Skaar, Timothy T. Watson, Greg C. Wicke, Dennis G. Flisram, Robert B. Glennon and Larry C. Gundlach It is certified that error appears in the above-identified patent and that said Letters Patent is hereby corrected as shown below:

In the Drawings, FIG. 7, delete "BEVEL AND WIDTH" and insert --BEVEL LANDWIDTH--; FIG. 9, delete "BEVEL LAND WIDTH" and insert --BEVEL LANDWIDTH--.

Col. 1, line 51, "to or avoid" should read --to avoid--.

Col. 5, line 26, delete "0.50°" and insert --0.5°--.

Col. 6, line 1, delete "then" and insert --than--.

Col. 7, line 36, "so--called" should read --so-called--.

Col. 12, line 27, "0° about" should read --0° and about--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*